US005293319A

United States Patent [19]

DeSha et al.

[11] Patent Number: 5,293,319

[45] Date of Patent: Mar. 8, 1994

[54] POSTAGE METER SYSTEM

[75] Inventors: Michael J. DeSha, Yorktown Heights, N.Y.; David E. Pitchenik, Fairfield, Conn.

[73] Assignee: Pitney Bowes Inc., Stamford, Conn.

[21] Appl. No.: 5,405

[22] Filed: Jan. 19, 1993

Related U.S. Application Data

[63] Continuation-in-part of Ser. No. 632,860, Dec. 24, 1990, abandoned.

[51] Int. Cl.[5] ..... G07B 17/00

[52] U.S. Cl. ..... 364/464.02; 364/464.03

[58] Field of Search ..... 364/464.02, 464.03

[56] References Cited

U.S. PATENT DOCUMENTS

| | | | |
|---|---|---|---|
| Re. 31,875 | 4/1985 | Check, Jr. et al. | 364/900 |
| 3,869,986 | 3/1975 | Hubbard | 101/72 X |
| 3,938,095 | 2/1976 | Check, Jr. et al. | 395/425 |
| 3,978,457 | 8/1976 | Check, Jr. et al. | 364/464.02 |
| 3,983,366 | 9/1976 | Gunn | 235/454 X |
| 4,241,994 | 12/1980 | Ryan, Jr. | 355/77 |
| 4,249,180 | 2/1981 | Eberle et al. | 375/2 |
| 4,253,158 | 2/1981 | McFiggans et al. | 364/900 |
| 4,301,507 | 11/1981 | Soderberg et al. | 364/464 |
| 4,302,810 | 11/1981 | Bouricius et al. | 364/200 |
| 4,307,293 | 12/1981 | Lazzarotti et al. | 235/462 |
| 4,334,771 | 6/1982 | Ryan, Jr. | 355/133 |
| 4,376,299 | 3/1983 | Rivest | 364/900 |
| 4,421,977 | 12/1983 | Kittredge | 235/101 |
| 4,447,890 | 5/1984 | Duwel et al. | 364/90 |
| 4,458,109 | 7/1984 | Mueller-Schloer | 178/22.11 |
| 4,511,793 | 4/1985 | Racanelli | 235/375 |
| 4,519,311 | 5/1985 | Lowe | 101/109 |
| 4,568,950 | 2/1986 | Ross et al. | 346/76 |
| 4,578,759 | 3/1986 | Horii | 364/478 |
| 4,581,616 | 4/1986 | Ross et al. | 346/76 |
| 4,588,996 | 5/1986 | Ross et al. | 346/76 |
| 4,605,937 | 8/1986 | Dolan et al. | 346/76 |
| 4,637,051 | 1/1987 | Clark | 382/1 |
| 4,641,346 | 2/1987 | Clark et al. | 380/3 |
| 4,641,347 | 2/1987 | Clark et al. | 380/3 |
| 4,649,266 | 3/1987 | Eckert | 235/432 |
| 4,660,221 | 4/1987 | Dlugos | 380/23 |
| 4,675,669 | 6/1987 | Goldman | 235/380 X |
| 4,746,234 | 5/1988 | Harry | 400/120 |
| 4,757,537 | 7/1988 | Edelmann et al. | 380/51 |
| 4,775,246 | 10/1988 | Edelmann et al. | 380/23 |
| 4,796,193 | 1/1989 | Pitchenik | 364/464.02 |
| 4,812,994 | 3/1989 | Taylor et al. | 364/464.02 |
| 4,813,802 | 3/1989 | Gilham et al. | 400/74 |
| 4,829,568 | 5/1989 | Clark et al. | 380/23 |
| 4,831,555 | 5/1989 | Sansone et al. | 364/519 |
| 4,857,942 | 8/1989 | Murphy et al. | 346/76 |
| 4,888,803 | 12/1989 | Pastor | 380/51 |
| 4,917,010 | 4/1990 | Gilham et al. | 101/93 |
| 4,924,240 | 5/1990 | Herbert et al. | 346/1.1 |
| 4,931,943 | 6/1990 | Vermesse | 364/464 |
| 4,934,846 | 6/1990 | Gilham | 364/464.02 X |
| 4,949,381 | 8/1990 | Pastor | 380/51 |
| 4,969,127 | 11/1990 | Gilham | 346/76 |
| 5,019,991 | 5/1991 | Sansone et al. | 364/464.03 |

FOREIGN PATENT DOCUMENTS

| | | |
|---|---|---|
| 0076972 | 4/1983 | European Pat. Off. . |
| 0376576 | 7/1990 | European Pat. Off. . |
| 0393896 | 10/1990 | European Pat. Off. . |
| 2073661A | 10/1981 | United Kingdom . |
| 2206082 | 12/1988 | United Kingdom . |

*Primary Examiner*—Edward R. Cosimano

*Attorney, Agent, or Firm*—Charles G. Parks, Jr.; Melvin J. Scolnick

[57] ABSTRACT

A system for processing documents with value markings thereon, having a reading element for reading the value markings, an accounting element for accounting for the value, and a marking element responsive to the accounting element for marking the document with information representing successful accounting of the value and uniquely identifying the accounting element. The marking element is positioned with respect to the document so as to cause the mark to be placed on the document. The value information, the reading element, the accounting element and the marking element are all positioned within a secure housing.

8 Claims, 4 Drawing Sheets

POSTAGE METER SYSTEM

This application is a continuation-in-part of application Ser. No. 07/632,860, filed Dec. 24, 1990, now abandoned.

FIELD OF INVENTION

This invention relates to a system for processing documents with printed values and accounting for same.

BACKGROUND OF THE INVENTION

In printed-value accounting systems, it is often necessary to provide complete secure housings which incorporate both a value-imprinting device, and all input devices related thereto, as well as accounting systems which provide for incrementing or decrementing values of accumulating registers in accordance with the value to be imprinted upon a substrate. The requirement of providing secure housings around all of this mechanism is both costly, space consuming, and provides certain security difficulties insofar as access to the various mechanisms are concerned. To avoid this problem, various attempts have been made to separate various functions from the secure housing in order to minimize the amount of equipment which must be contained within the secure housing. For example, in accordance with one well known procedure for processing mail, it is necessary for a user to purchase stamps at a Post Office, and to apply such stamps to an envelope or package at a later time. There is no need in such a process for the user to account for the postage to the Post Office, since this is effectively done by the Post Office at the time of the purchase.

In order to overcome the inconvenience of prepurchasing stamps and applying them to envelopes or packages, it is well known to employ a secure Postage Meter at the user's location. This procedure, however requires the purchase or rental by the user of a secure Postage Meter that simultaneously prints postal indicia on the envelope, and also accounts for the printed postage. The printer in such a Postage meter is necessarily secure, and the indicia must be in a proper form in accordance with Postal Regulations, to ensure that it can be read for verification purposes at the Post Office. In such a system, the presence of proper indicia on the mail piece is understood by the Post Office to show that the necessary postage has been paid for.

Speed of processing is improved by eliminating necessity of changing or re-setting print wheels. Economy is achieved by virtue of a design which eliminates the need for mechanics which change or re-set the print wheels. Ink jet printing such as found in U.S. Pat. No. 3,869,986 while useful in printing devices, are subject to clogging and are not as reliable as a simple stamp imprint device.

In an attempt to overcome these problems, it has been suggested in U.S. Pat. No. 4,934,846, issued Jan. 19, 1990 European Patent Application Publication No. 0376576, published Jul. 4, 1990, U.S. Pat. No. 4,796,193 issued Jan. 3, 1989, German Patent 2,193,468 May 15, 1991 and assigned to the assignee of the present inventors, to provide an unsecured mechanism for printing postage values on a mail piece or tape adapted to be applied to a mail piece. The printed postage values simulate postage stamps, in a certain sense, but they do not represent postage that has been paid for or accounted. As in the case of the use of conventional stamps, the value markings must be read at the Post Office and canceled. In addition, it is necessary for the Post Office itself to account for the value, for example to the account of an entity who has prepaid for the service and whose identification appears on the mail piece. Thus, while the arrangement may simplify the task of the user, it increases the required efforts of the Post Office. In addition, such a system does not readily permit the user to provide accounting, a feature which is often a requirement in modern postage-meter technology, as well as in any value accounting system wherein the user wishes to keep track of a single account as in conventional individual postage meters, or a multiple account database system with regard to specific sets of values imprinted upon documents.

While U.S. Pat. No. 4,796,193 shows placing a mark on the document, such reference does not show that such mark represents the source of the mark. Also, this reference calls for a manifest system, unlike the simpler stand-alone concept herein. The system of the above described references are accordingly not a value accounting system for indicating an accounted value, since it does not easily identify the source nor indicate in any manner that a proper accounting has been done. Elective verification of value accounting by identification of source and certification of accounting is useful both from a user viewpoint, and from an authority's viewpoint, should the value printing be employed in a value-accounting system which requires ultimate verification by the use of a central authority, such as the United States Postal Service. The same may also be applicable with regard to express mail and package delivery as well as other forms of delivery requiring prepaid delivery charges. With this system, verification need only be done on an elective or random basis, thus reducing the burden on central authority figures.

It is therefore desirable to provide a relatively simple means for validating and certifying accounting of printed values, such as postage or the like, printed by a printhead located in a non-secure environment, and securing only the accounting device which can also provide a unique observable and verifiable validation of accounting for later verification.

SUMMARY OF THE INVENTION

The present invention thus comprises a reader and accounting counting mechanism which is unique to the meter. The reader portion reads the printed information as to the value printed on a substrate, either manually or automatically by the user's own printer, and marks the substrate with a unique impression in order to certify that accounting for the printed amount has taken place. This unique impression not only verifies the accounting, but uniquely identifies the source of the accounting device. The reader-accounting and print-marking devices which may be at the user location are all secure, while the value-printing mechanism which may also be at the user location, as well as a subsequent verification device can be located in nonsecure environments.

More specifically, a substrate is printed with a value using any sort of matrix or other type of printing device. Bar code or other types of printing media are printed to encode the value in an easily machine readable code. The substrate is then placed into a reader where either the human-readable value is scanned by optical-character recognition or bar code scanned by an appropriate bar-code reader to input the value data on the document or substrate into the accounting system. When accounting is taking place, the printer is released to mark upon the document an information to both identify and to certify that accounting for the value amount has thus taken place. This information is marked in a manner unique to the particular marking device. The reader accounting and marking device are all maintained in a secure manner. Since the value printer, the accounting device and the certification device are located at the user location, the need for encryption by the value printer is eliminated.

For best results, the value information read by the machine may be canceled or defaced or overridden in order to prevent the value from being changed after accounting has taken place, and to provide to the delivery system a rapid visual aid to determine that accounting has in fact been done. If desired, encryption techniques may be employed in conventional software to provide additional security. In addition, the machine can be coupled to a modem or use conventional postage resetting techniques. To provide error checking, the reader could be employed with a redundant reader and employ coded markings. Amounts to be entered may be provided to the device either by keyboard input or other forms of electronic coupling.

More specifically, the present invention relates to a method and apparatus for processing a document having printed values thereon, comprising, a reader for reading the value, accounting means for accounting for the value, and marking means responsive to the accounting means for marking the document with information representing both successful accounting of the value and uniquely identifying the accounting means. The marking means is positioned with respect to the document serves to cause the information to be placed on the document, the reading means, accounting means and marking means all being positioned within secure housing. The value information as for example, the amount of postage, may be manually entered or automatically printed thereon.

DETAILED DESCRIPTION

Figure 1:
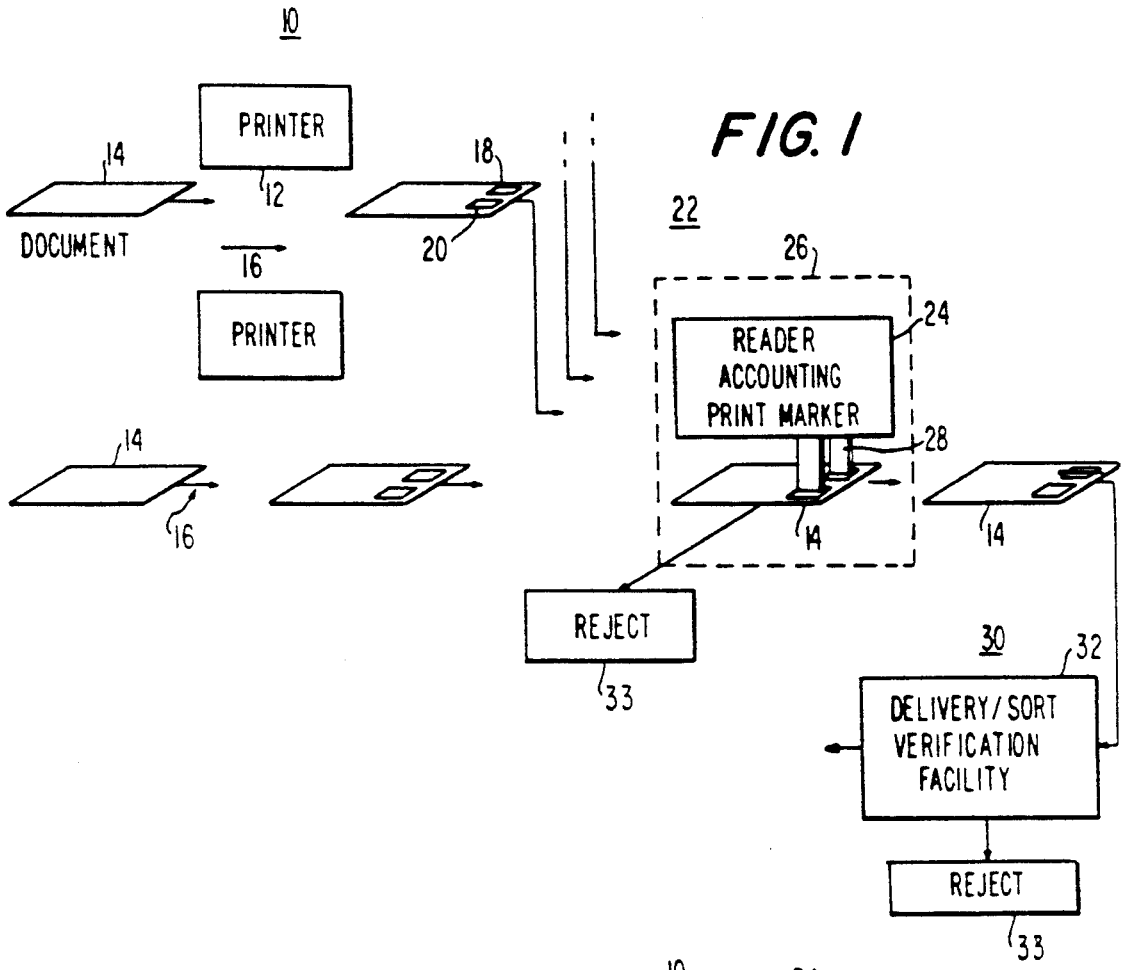
FIG. 1 is a generalized block diagram of three stages of on embodiment of the system of the invention.

Referring to FIG. 1, the generalized block diagram of the present invention is described. In generalized form, the system consists of three separate stages. The first stage is the printing stage, the second stage a reading, accounting and printmarker stage, and the third stage a delivery sort/verification stage. In the first stage 10 one or more printing devices 12 receive documents 14 located upon appropriate conveying devices 16 and act to imprint upon such documents a value information 18 located on the document at one or more appropriate locations. The term information as used herein includes a specific set of markings in human and/or machine readable formats. The document may also include data 20 identifying the data base or account to which the value is to be charged. The document is then fed to a second stage 22 which includes a reader-accounting-print marking unit 24 located within a secure housing 26. The reader-accounting-print marking unit 24 acts to read the document, account for the value 18 printed thereon, and then provide a marking on the document in response to the accounting for marking the document with accounting information representing successful accounting of the value information and uniquely identifying the user or source of the accounting device. The marking mechanisms indicated generally as 28 are positioned with respect to the document 14 so as to provide marking in an appropriate location to over-write the value information 18 preprinted or otherwise placed on the document 14. The document 14 may then be delivered to a third stage 30 which includes a delivery/sort verification facility 32 which possesses the capability of analyzing the marking overwritten on the value information for verifying that the value information has been properly overwritten and to identify the account or source of the charging unit. Failure of either stages 22 or 30 to properly account or verify results in rejection 33 of the document, thereby activating appropriate alarms to indicate to the user that the system has failed to properly verify information provided on the document.

Figure 2:
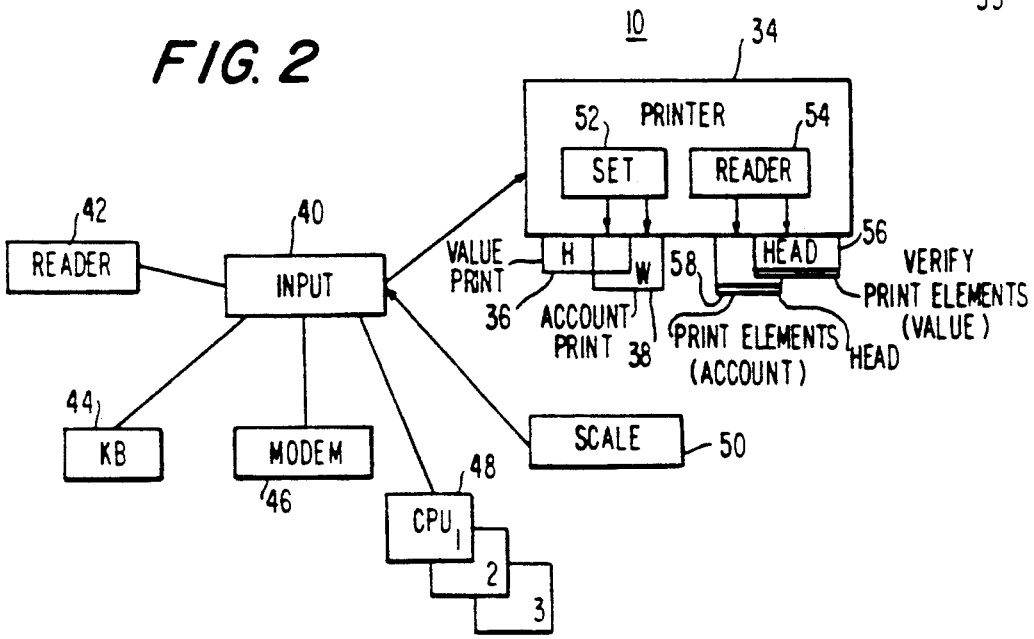
FIG. 2 is a more detailed block diagram of the printing mechanism of FIG. 1.

Referring to FIG. 2, a more detailed analysis of the printing stage 10 is provided. Thus, a printing mechanism 34 is shown for providing appropriate value and account data printing on the document. In accordance with the invention this printing stage 10 is preferably not secure, since security will be provided by the second stage 22 when accounting for value data actually takes place. Since the cost of securing printing facilities is substantial, the present invention realizes the advantage of removing the value and account printing facility from the secure housing, thereby reducing costs of operation and facilitating ease of placement of value and account data on the document. The printer 34 may be any suitable type of printer for printing information, such as a dot matrix printer, utilizing a series of pins individually energized to form characters, or a thermal printer which may comprise a line of printing elements selectively energizable to heat selected print elements for the purpose of providing appropriate marking on thermal or heat sensitive paper. Entering information by hand is also contemplated. It will be understood that printing may take place upon a paper tape, an enclosure containing information, such as a postage envelope used in mail, or any printable substrate which is required to contain value and account information. The location of the printing on the envelope or tape is a matter of choice as is the nature of the printing (human readable or machine readable or both). Thus, the printing and location of the value, account (user identification) department or budget account are a matter of choice depending upon the delivery process, such as postal service regulation, and the printer and reader employed.

The value information may be inserted manually or automatically. The document may thus consist of an envelope, a tape which is affixed to a package, an invoice, or other appropriate value indicating informational substrate. The printer 34 includes at least one printhead 36 for printing value upon the document. It is also preferable to include a further printhead 38 which may, at a different location on the document, print account database information which identifies the particular user for accounting purposes with respect to the value printed on a specific document. It will be understood that a single user may not require separate account database information, since only one account is present. However, for a typical large scale user facility, it is desirable to have separate informational areas which include both value printing and database account printing. Although one advantage of this invention is that encryption is not necessary since accounting is done at the user location, it will also be understood that the value and database printing may consist of separated or combined areas of encrypted information, printed in forms of barcode, alpha-numeric code, or any specific code which may be machine readable or operator readable for the purpose of verifying data imprinted thereon. Encrypted databases which may be incorporated onto the document include those disclosed in U.S. Pat. No. 4,649,266 assigned to the assignee of the present invention, the disclosure of which is incorporated herein by reference.

The first stage printer 34 may be activated by appropriate input devices to input 40 which receives inputs from a plurality of devices which may affect the values imprinted thereon. Thus, the input device 40 may include a reader 42 for reading value information from a manifest which has previously been generated for the purpose of imprinting value on a plurality of documents in a mass production operation. Input may also be provided manually through a keyboard 44, a modem 46 which may receive information over a telephone line long distance, or a plurality of CPUs 48, acting singly or in tandem which can receive data from a plurality of distant computer station such as terminals for printing value on the document. Where the document relates to postage or delivery systems where weight is a factor, a scale 50 may be provided and weight information accounted for from a database of appropriate weights based upon delivery. Systems for imprinting value based upon weight and destination, such as used in private-package delivery services, or the U.S. Postal Service, are well known.

Printer 34 includes a mechanism 52 which responds to the codes provided by the input device 40 for setting the printheads 36 and 38 to print the value and database information which uniquely identifies the user upon the document. Such print setting mechanisms are well known and not described in detail herein, however it will be understood that the feeding mechanism and printer are coordinated such that the location of the value printing and accounting printing information may be provided at any appropriate point selected by the operator anywhere upon the document. The printer 34 may further include a reading mechanism 54 located downstream of the document immediately thereafter printing for verifying that value and database print information have been properly printed upon the document. This operates by appropriate read heads 56 and 58 located in juxtaposition to the value printing and accounting printing heads 36 and 38 so that data previously printed on the document can be read and verified. Reading the print data at this time is done solely for the purpose for ensuring that the printheads have operated properly and is not done for purposes of verifying or accounting for the data printed thereon. Thus, the entire mechanism 34 and 40 of the stage 10 need not be located in a secure housing since none of these operations relate to accounting or verification purposes for accounting, nor do they provide appropriate data or information which will allow a delivery service utilizing this system to act upon the information printed on the document at this stage.

Figure 3:
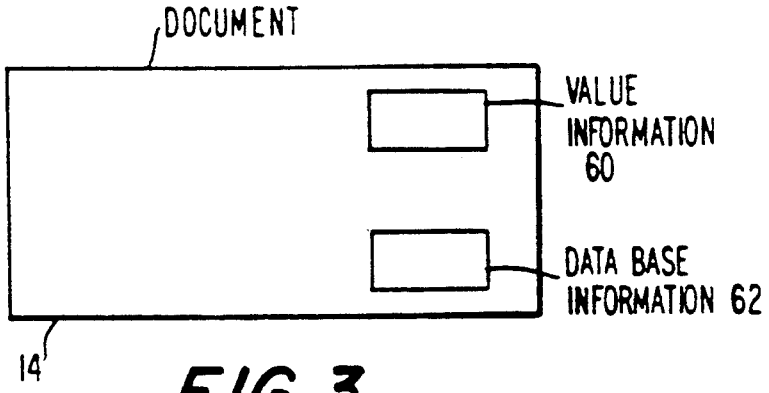
FIG. 3 is a front view of a document containing information thereon for use with the present invention.

Document 14 will, as indicated in FIG. 3, contain at least one value information 60 printed in an appropriate location thereon and may also include separate database information 62 printed at another location, or at least at a location separating readable relative to said first location on the document 14. As indicated previously, the value information 60 and the accounting database information 62 may be printed in a single combined print area in such a manner that later verification and reading facilities may be able to read the data for purposes of identification and accounting.

Figure 4:
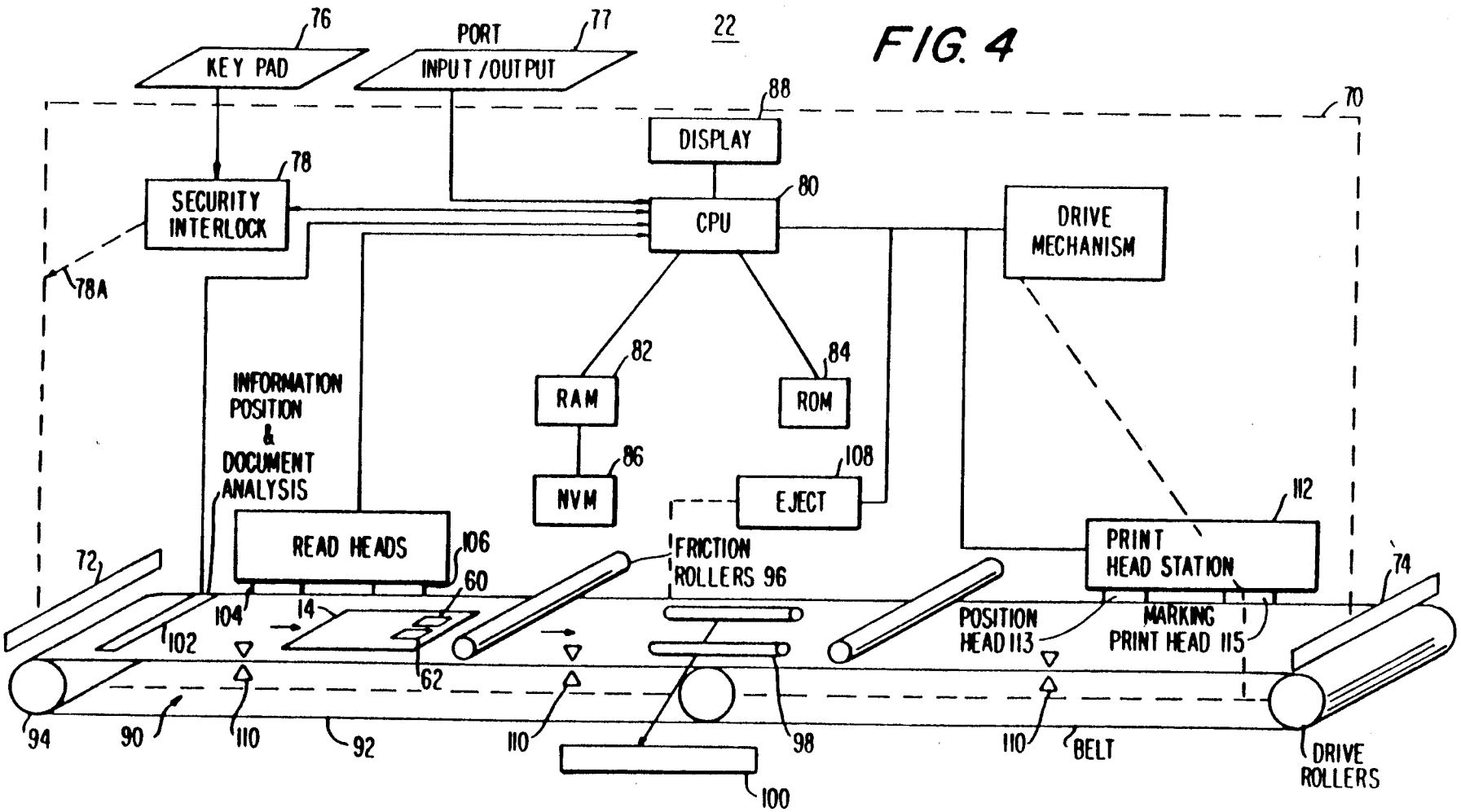
FIG. 4 is a detailed block diagram of the marking and accounting mechanism employed within system of the present invention.

Referring now to FIG. 4, the second stage 22 is illustrated in greater detail. As briefly explained heretofore, the purpose of the second stage 22 is to account and certify for the value imprinted by the first stage 10 on document 14. Since the accounting mechanism requires security due to the sensitive nature of accounting information, the second stage 22 is enclosed within a secure housing 70, shown in dashed line surrounding the principal portions of the mechanism of stage 22. The secure housing 70 is a rigid structural enclosure having appropriate locking mechanisms or other security devices, not shown. The structure may include an input slot 72 located at one end of the secure housing 70 and an output slot 74 at the other end. The size of these slots are within the parameters defined by the documents to be processed, however since the document is usually either of an envelope, invoice or paper-tape variety, the slot may be generally made of relatively narrow gauge openings and widths, to thereby further facilitate the security of the secured house 70. Access to the interior of the housing is provided through an input port 77, which can also accommodate a direct signal from a remote source. The port is located on the exterior of the secure housing. The key pad 76 interfaces with a security interlock interface 78 within the secure housing to provide both access to the secure housing, such as for unlocking the housing, as well as for allowing data input into the secure housing 70. The security interlock interface 78 is a standard digital key pad encoding device operative to receive data from the keypad 76 and conducts same in encoded digital form to a microprocessing unit which consists of a central processor or (CPU) 80, random-access (RAM) memory 82 for holding temporary data as processed by the CPU 80, a read-only (ROM) memory 84 for permanently holding data such as the operative program and the various specific identification codes which may be applicable to the different accounting databases, and the like. The random-access memory 82 further includes non-volatile (NVM) memory 86 which is a battery backed up memory system provided for the purpose of holding data when power fails or is no longer supplied to the second stage 22. Since the CPU 80 interfaces with the security interlock system, the CPU maintains records of access to the secured housing 70 by encoding and saving access data each time the keypad is activated by appropriate access input data for the purpose of unlocking the secured housing. The unlocking of the secured housing is effected by the security interlock 78 as schematically indicated by the dashed line 78A when input data from the keypad 76 is confirmed upon receipt of appropriate verification from CPU 80. This microprocessor unit further includes a display device 88 which may be employed at various points of the operating program of the second stage 22 to display appropriate data as required. Data displayed may include the value information read from the document, for verification or error checking, the remaining balances on each account database, totals of verified value information over a fixed time period and the like.

The second stage 22 further includes a transport mechanism illustrated generally as 90 which includes a conveyor belt 92 and a plurality of drive rollers 94 cooperating with pluralities of friction rollers 96 for driving a document 14 from the input slot 72 through to the output slot 74 along the conveyor belt. Ejection mechanisms, as will be further described herein, include a plurality of transversely positioned friction rollers 98 appropriately located along the transport belt 92 for the purpose of ejecting a document through the ejecting slot 100.

In operation, the document is directed through input slot 72 to the first station 102 of stage 22 which includes a plurality of read heads 104, 106 which locate the position of the preprinted information and also provide for document analysis. The read heads may be CCD (charge coupled devices), OCR mechanisms, and the like, as are well known in the art. The information position enables the CPU to precisely locate the value information 60 and accounting-data base information data 62 on the document 14 for appropriate reading by the read heads 104 and 106 respectively. The document analysis may also take into account specific characteristics of the document for detection of counterfeits or fraudulent documents, in a manner such as is found in U.S. Pat. No. 4,675,669, disclosure of which is incorporated herein by reference, and which provides means for determining counterfeit documents by analysis of the substrate or characteristics of the document itself. Data from such analysis and position indications are fed to the CPU 80 which provide appropriate control signals to the read heads 104 and 106 for activating sensors such as OCR, barcode reading, or other appropriate information sensing mechanisms adapted to the specific information data printed upon the document 14 for purposes for reading same. The document is then processed through the read head stations 104 and 106 where the data thereon is read and provided to the CPU 80. It will be understood that failure of the information position and document analysis station 102 to identify or authenticate a document will give rise to appropriate control signals to the CPU 80 for activating the eject mechanism 108, which will in turn activate, by appropriate drive mechanisms, the transverse rollers 98 and drive the document upon reaching those stations through the eject slot 100 for appropriate processing.

A plurality of document sensing stations 110 are located at appropriate locations along the transport mechanism 90 so as to provide continuous data to the CPU of document location so that the CPU 80 is aware of the document position at all times during the transport operation mechanism. Upon reading value data from the document 14, the CPU 80 identifies the value and the accounting database of the specific user account to which the value indicated by the preprinted value data is to be decremented. Appropriate memory information contained within the memory units of the microprocessor are then decremented by the value provided. Next, new balances are calculated, and authentication of such value to the appropriate accounting database then made by proper decrementing of the specific account to which the document being processed relates. Failure to account, caused by such reasons as counterfeit documents, insufficient funds, an unidentified account database, or other alarm conditions which having been previously set into the CPU 80, will in turn cause activation of the eject mechanism and the further activations of appropriate alarms as may be desired. Accounting systems for accounting for postal data are well known and are disclosed in prior art patents Reissue No. 31,875 issued Apr. 30, 1985 and U.S. Pat. No. 4,301,507 issued Nov. 17, 1981, are assigned to the assignee of the present invention, the disclosures of which are each incorporated herein by reference. Although not specifically shown, it will be understood that the CPU 80 provides appropriate signals based upon clocking signals to motor drives. This is for the purpose of maintaining the transport mechanisms, friction rollers, eject mechanism, and processing through all the read stations at constant rates so that reading at appropriate rates and continuous location of the document through the transport mechanism is maintained. These techniques are within the skills of the art and will not be described further herein.

After proper reading and verification of both value information and database information, the document is continuously transported through the transport mechanism to the printhead station 112. At printhead station 112, a marking device for the purpose of printing a mark in response to the success of appropriate accounting of the value information in the CPU 80 is activated to provide the document with the accounting information which represents successful accounting of the preprinted value information previously read on the document 14. This print mechanism may be any suitable type of printer, such as a dot matrix, thermal, or impact type of printer or the like activated to cause a mark to be imprinted upon the document 14 in a position so as to over-write the preprinted value information. The purpose of this is to provide appropriate indication upon the document that accounting has been successfully completed for the value indicated, and to provide an indication to delivery or sorting facilities relating to further processing of the document that proper accounting has taken place. Preferably, a mechanical marking device may be employed which imprints a unique pattern on the document. The unique pattern may be in the form of a mechanical imprint, the effect of which is to create a series of physical impressions on the document. These impressions will be unique to the marking device, and thus be capable of providing a means to identify the origin of the imprint for later verification. The print head mechanism 112 includes a position head 113 which senses the value data 60 (FIG. 5) already imprinted on the document 14 and positions the marking head 115 so as to overprint 114 (FIG. 5) the value information 60 located on the document 14. It will be understood that the overprint mark 114 may be located elsewhere on the document, however overprinting the value information area is preferred since it decreases fraud possibilities by partially obscuring the value area, thereby making copying more difficult. In addition, the overprinting of the accounting data over the value information results in a combinational overprint which is both difficult to reproduce for purposes of fraudulently defeating the system, as well as providing a means by which further verification of the proprietary of the accounting data with respect to the imprinting thereon of the document and the proper operation of the system may take place. At the completion of the overwriting, the document is then ejected through the eject slot 74 and the operation of stage 22 is then complete.

It should be recognized that rather than printing a unique identifying mark of the meter, unique identifying data, such as a serial number can be preprinted and scanned by the reader. The scanned data would be compared and verified that it correctly identified the meter before the mark printer is released for operation.

The document may be delivered or processed in a delivery/sorting verification facility indicated as stage 30 or the third stage of the present system. The delivery/sorting verification facility may include a United States Post Office if the document is a piece of franked postage designed for delivery within a governmental postage system. It may also be a manifested receipt employed by private delivery services such as package or overnight mail delivery services, or may relate to any value imprinting systems requiring accounting verification which may be done on an item by item basis or on a random basis for the purpose of verification.

Figure 5:
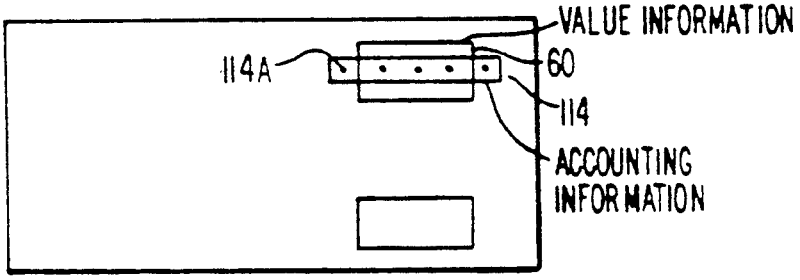
FIG. 5 is a detailed view of a document including the marking effects of the mechanism of FIG. 4.
Figure 6:
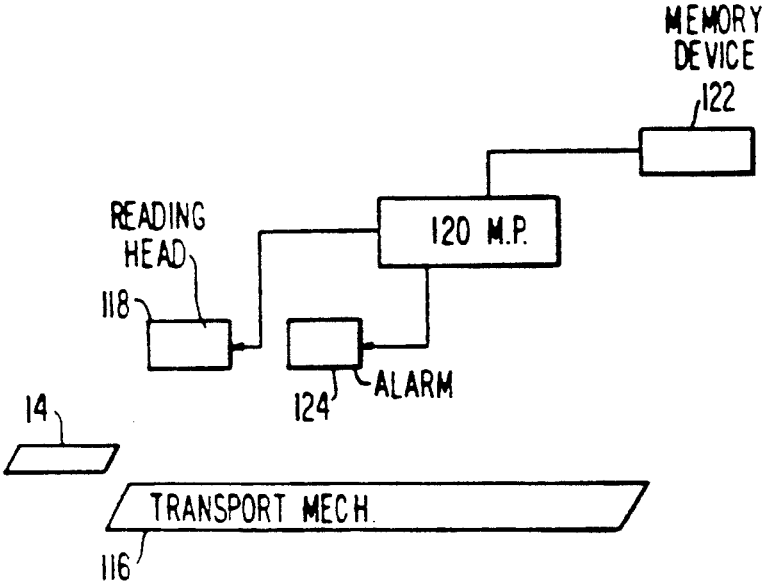
FIG. 6 is a block diagram of a validation or third stage device of FIG. 1.

The document as it is delivered to the third stage 30 may be as it is described with reference to in FIG. 5, wherein the overprinted accounting data 114 overlies the value information 60 in a manner to indicate cancellation thereof. As shown in FIG. 5, the area 114 includes a unique physical or imprinted pattern 114A which uniquely identifies the source thereof. This identification may be purely visual, as by virtue of a complex pattern, or electronically sensed for identification later. The operation of the device employed in the third stage is described in greater detail with reference to FIG. 6.

The operation of the verification facility, although not shown in great detail, provides for a transport mechanism 116 for receiving the document placed thereon, and includes a reading head 118 operating in conjunction with a microprocessing or other computing device 120 for reading the overprinted accounting information and value information. The microprocessor responds to the read data, in accordance with appropriate database memory 122 so as to compare certain characteristics of said mark, either physical positioned or electronically sensed, with corresponding data prestored in memory, for validating the mark so as to verify that the account is a valid account, that the value is a proper value, and that the relationship between it and the accounting information is appropriate. Thus, the information regarding the physical imprint 114A, electronic position sensing of 114A, its relative position, encryption, encoding, or other means have been previously coordinated. This coordination is between data information provided in the second stage 22, which controls the original imprinting mechanism, and corresponding data information stored within memory device 122 of microprocessor 120 for the purpose of verification. Failure to accurately account results in appropriate signalling to alarm device 124 which may then be suitably acted upon by appropriate authorities. It is again not necessary for this verification mechanism to be secure since no specific accounting is done. It is also possible for the verification reader to read the value on said document for verification purposes or audit functions.

Figure 7:
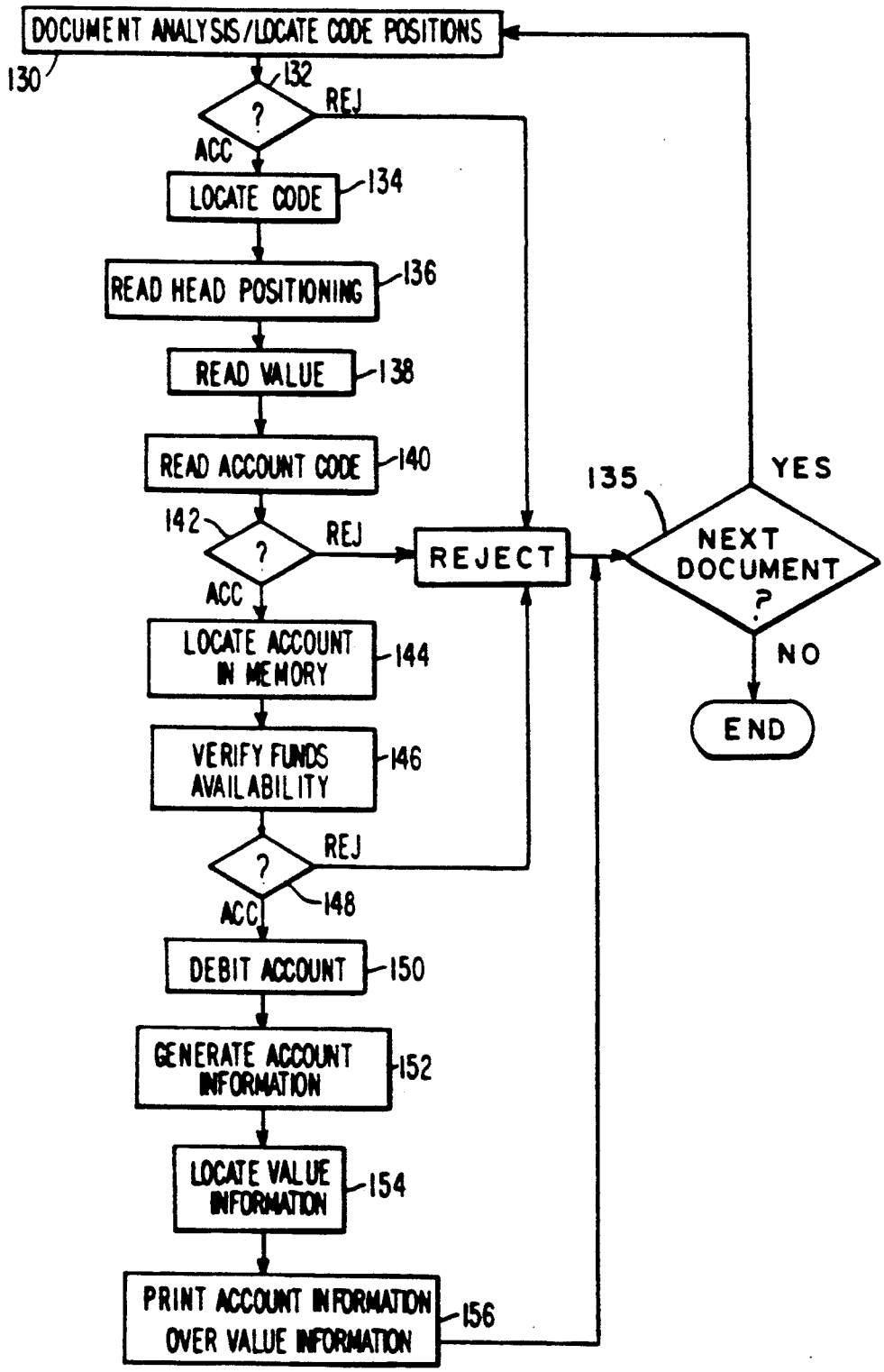
FIG. 7 is block diagram of a flow chart illustrating the software operation of the present invention.

For purposes of explaining the operation of FIG. 4 in greater detail, FIG. 7 illustrates a simplified block diagram of the method employed by the program stored within the read-only memory 84 of second stage 22 described in further detail. Thus, the software or programmable flow of steps employed by the CPU 80 of the second stage 22 consists of a first step of document analysis 130 followed by a second step decision block 132 for acceptance and proceeds to location 134, or rejection of the document based upon the document analysis and proceeds to location 135. The next step is code location 134, causing read head positioning 136, and then value reading 138. Next, account code reading 140 occurs, followed by an acceptance/rejection decision block 142 based upon the propriety of the account code. If accepted, the account code is located in memory 144, and verification of funds availability determined in block 146. If rejected, the software proceeds to location 134. Decision block 148 determines the acceptance and proceeds to location 150 or rejection based upon funds availability and proceeds to location 135. Block 150 which is account debiting next occurs. Following account debiting, account information is generated in block 152 through the CPU. The overwriting device then locates the specific position of the value information block 154 and then accounting information is imprinted over the value information in block 156. It is appreciated that following a rejection decision at 132, 142 or 148 and after the information printing has occurred at 156, the system checks for the next document. If there is a next document, the system returns to block 130. If there are no more documents, the system routine is ended.

It will be appreciated that locating account information will not be required in instances of a stand-alone, or simple account device. It will also be appreciated that the invention described herein provides a postage metering apparatus suitable for use at a user's facility which provides the security features of a postage meter for protection of both the users and Post Office's funds without requiring a value printer within the postage meter itself.

Other variations and modifications, including both hardware and software, within the scope of the inventor will be apparent to those skilled in the art.

What is claimed is:

1. A system for processing documents with printed values, comprising:

first printing means for printing information representative of value on a document, second printing means for printing database information representative of an account to be debited by said value, first reading means for reading said value information, second reading means for reading said database information, accounting means for accounting for said value, said accounting means being responsive to said second reading means for debiting an account identified by said database information by the amount of said value, marking means responsive to said accounting means for marking said document with a mark uniquely identifying said marking means and representing successful accounting of said value, said marking means being positioned with respect to said document so as to cause said mark to overwrite said value information, said reading means, accounting means and marking means all being positioned within a secure housing, said secure housing includes input means, a central processor, and a memory, said input means being accessible from outside said secure housing and being coupled to said central processor, said central processor being responsive to entry of an access code in said input means to provide access to said secure housing and storing a record of said access in said memory, validation means located outside said secure housing for verifying said mark, said reading means includes means responsive to a failure to properly accounting by said accounting means to provide an ejection signal, and ejection means responsive to said ejection signal to eject said document from said reader prior to said marking means.

2. The system as claimed in claim 1 wherein said printing means includes an input means responsive to inputted value data for setting a printhead to print said value information.

3. A system for processing documents with printed values, comprising:

first printing means for printing value information representative of value on a document, second printing means for printing database information representative of an account to be debited by said value, first reading means for reading said value information, second reading means for reading said database information, accounting means for accounting for said value, said accounting means responsive to said second reading means for debiting an account identified by said database information by the amount of said value, marking means responsive to said accounting means for marking said document with a mark representing successful accounting of said value and uniquely identifying said marking means, said marking means positioned with respect to said document so as to cause said mark to over-write said value information, said reading means, accounting means and marking means all being positioned within a secure housing, validation means located outside said secure housing for verifying said mark, said validation means including means for reading said mark, means for analyzing said mark and comparing said analysis to pre-stored data, and means responsive to said comparison for verifying the authenticity of said mark, said secure housing includes input means, a central processor, and a memory, said input means accessible from outside said secure housing and coupled to said central processor, said central processor responsive to entry of an access code in said input means to provide access to said secure housing and storing a record of said access in said memory.

4. The system as claimed in claim 3 wherein said printing means includes an input means responsive to inputted value data for setting a printhead to print said value information.

5. The system as claimed in claim 3, wherein said reading means includes means responsive to a failure to properly account by said accounting means to provide an ejection signal, and ejection means responsive to said ejection signal to eject said document from said reader prior to said marking mean.

6. A system for processing documents with printed values, comprising:

first printing means for printing value information representative of value on a document, second printing means for printing database information representative of an account to be debited by said value, first reading means for reading said value information, second reading means for reading said database information, accounting means for accounting for said value, said accounting means responsive to said second reading means for debiting an account identified by said database information by the amount of said value, marking means responsive to said accounting means for marking said document with a mark representing successful accounting of said value and uniquely identifying said marking means, said marking means positioned with respect to said document so as to cause said mark to over-write said value information, said reading means, accounting means and marking means all being positioned within a secure housing, and validation means located outside said secure housing for verifying said accounting information, said validation means including means for reading both said mark and said value information, said validation means including a microprocessor, a memory and a reader, said reader including means for reading said information, and said microprocessor and analyzing data from said reader for verifying the propriety of said mark, said secure housing includes input means, a central processor, and a memory, said input means accessible from outside said secure housing and coupled to said central processor, said central processor being responsive to entry of an access code in said input means to provide access to said secure housing and storing a record of said access in said memory.

7. The system as claimed in claim 6 wherein said printing means includes an input means responsive to inputted value data for setting a printhead to print said value information.

8. The system as claimed in claim 6, wherein said reading means includes means responsive to a failure to properly account by said accounting means to provide an ejection signal, and ejection means responsive to said ejection signal to eject said document from said reader prior to said marking mean.

* * * * *